United States Patent [19]

Bini

[11] 4,112,712

[45] Sep. 12, 1978

[54] ROCKING JACK SAFETY DEVICE

[75] Inventor: Franco Bini, Florence, Italy

[73] Assignee: Macchine Tessili Circolari Matec S.p.A., Rome, Italy

[21] Appl. No.: 811,822

[22] Filed: Jun. 30, 1977

[30] Foreign Application Priority Data

Jul. 21, 1976 [IT] Italy ..... 9534 A/76

[51] Int. Cl.[2] ..... D04B 35/10

[52] U.S. Cl. ..... 66/157; 66/50 R

[58] Field of Search ..... 66/50 R, 50 B, 57, 40, 66/154 R, 157, 165

[56] References Cited

U.S. PATENT DOCUMENTS

| | | | |
|---|---|---|---|
| 2,113,053 | 4/1938 | Leedham et al. | 66/50 |
| 2,340,049 | 1/1944 | Fregolle | 66/50 |
| 3,063,269 | 11/1962 | Losert | 66/50 |
| 3,577,749 | 5/1971 | Wright | 66/50 |
| 3,688,526 | 9/1972 | Worner | 66/165 |
| 3,922,886 | 12/1975 | Moyer | 66/50 R |

*Primary Examiner*—Ronald Feldbaum

*Attorney, Agent, or Firm*—Haseltine, Lake, & Waters

[57] ABSTRACT

A circular knitting machine has rocking selector jacks, selected ones of which are raised in a raising zone by means of a raising cam. A cam is provided in correspondence of the raising zone with a lower profile extending parallel to the intended trajectory of the other, non-selected, jacks to engage butts of these jacks whereby to prevent them from being raised unintentionally.

3 Claims, 3 Drawing Figures

24
22
26
20
f3
28
3
20A
1

ROCKING JACK SAFETY DEVICE

BACKGROUND OF THE INVENTION

1. Field of the Invention

The present invention relates to knitting machines, and more particularly to circular knitting machines, for example for knitting hosiery.

2. Description of the Prior Art

There have been proposed circular knitting machines having rocking selector jacks, selected ones of which are raised by a raising cam so as to raise the associated needles. The other jacks are free to move vertically within the respective grooves of the needle cylinder and in order to prevent unintentional raising of these jacks, and thus erroneous actuation of the associated needles, each of the jacks is curved along its length so that it bears against the sides of the groove. The friction produced between the jacks and the sides of the cylinder grooves acts to resist unintentional raising of those jacks which are not selected to be raised by the raising cam.

This previously proposed arrangement is, however, not entirely satisfactory at increased rotational speeds of the needle cylinder, since the friction between the jacks and the sides of the grooves leads to a heating effect, and the frictional forces are insufficient to ensure that none of the non-selected jacks are raised under the effect of the incidental forces which may arise at increased speeds.

SUMMARY OF THE INVENTION

According to the invention, there is provided in a circular knitting machine, rocking selector jacks having butts including selection butts, needles associated with the jacks, means co-operating with the selection butts to provide a selection of said selector jacks, a first, raising cam for raising the selected jacks whereby the associated needles are raised in a zone to take a yarn, and a second cam located in correspondence of said raising zone, said second cam having a lower profile extending parallel to the trajectory of the jacks which have not been raised by the raising cam, said lower profile of the second cam co-operating with a butt of the latter jacks to prevent unintentional raising thereof.

Further according to the invention, there is provided in a circular knitting machine, a needle cylinder, rocking selector jacks carried by the needle cylinder, said jacks having butts including selection butts, needles carried by the needle cylinder and associated with the selector butts, thrust means arranged to act on the selection butts to provide a selection of said selector jacks, a first, raising, cam for raising selected ones of the jacks in accordance with the selection determined by the thrust means whereby the associated needles are raised in a zone to take a yarn, means defining a guide track having a lower profile which co-operates with a butt of the jacks, said lower profile of the guide track having a concave portion in the raising zone and which follows the trajectory of the butts of the raised jacks, and a second cam located in correspondence of said raising zone, said second cam having a lower profile extending parallel to the trajectory of those jacks which have not been raised by the raising cam, said lower profile of the second cam co-operating with a butt of the latter jacks to prevent unintentional raising thereof.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
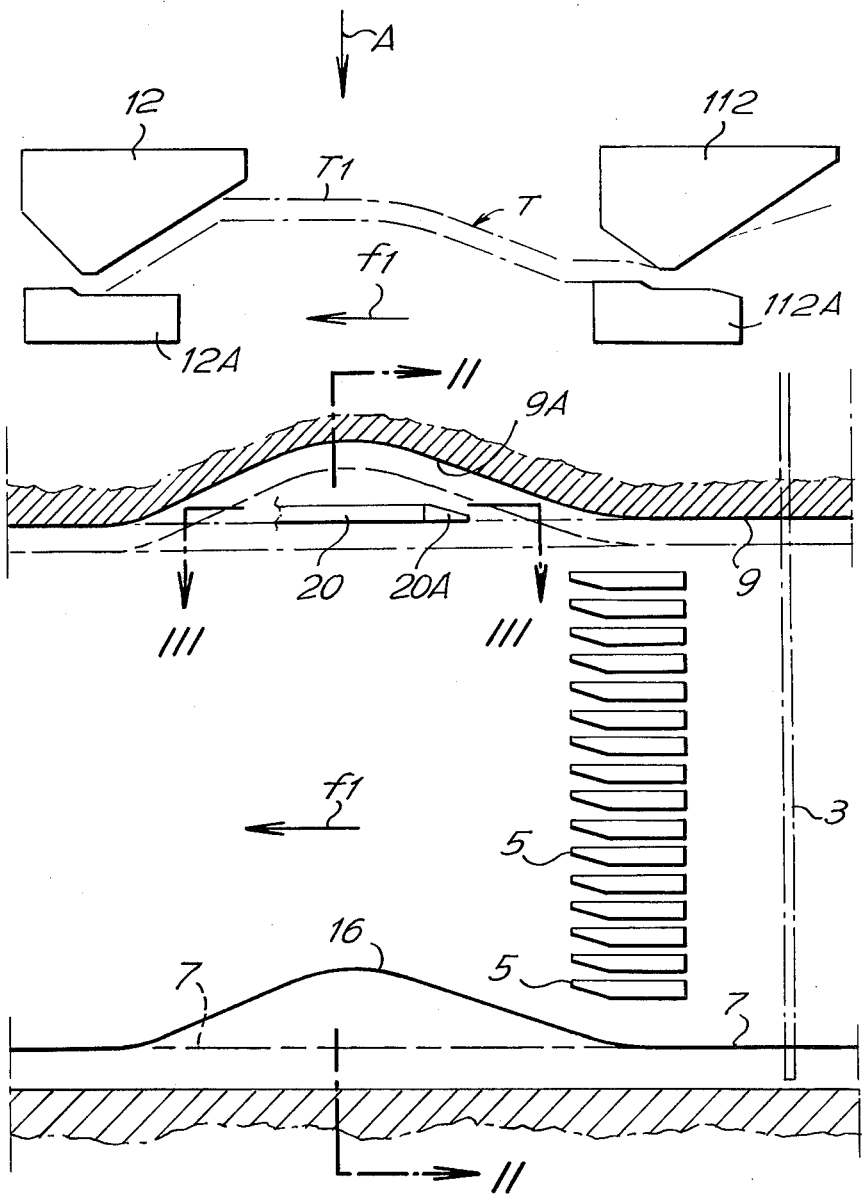
FIG. 1 is a schematic developed view of a cam shell of a circular knitting machine in accordance with the invention.
Figure 2:
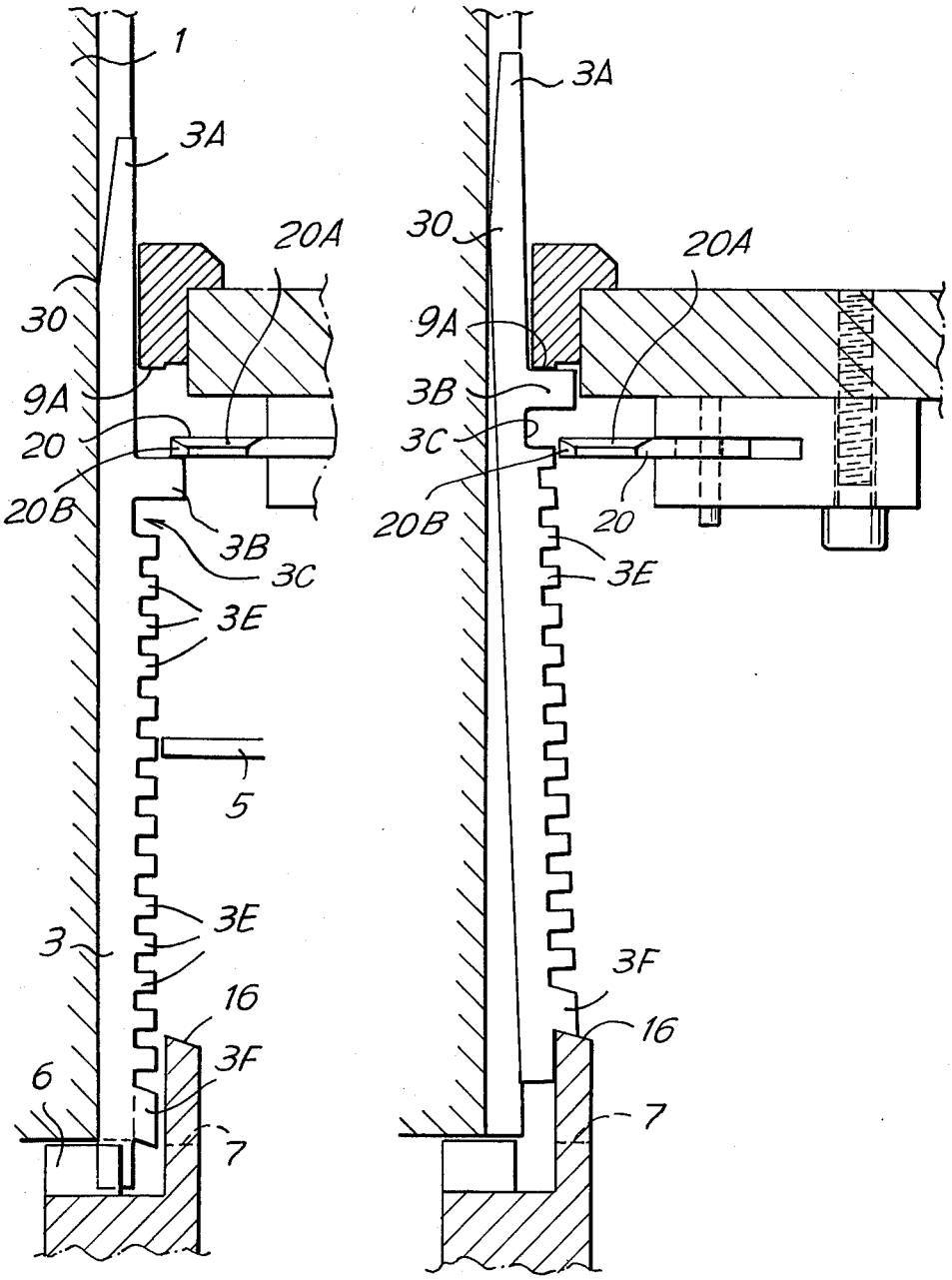
FIG. 2 is a section taken on line II—II of FIG. 1 and showing a selector jack in a lowered and a raised position.

There is shown in the accompanying drawings a needle cylinder 1 having longitudinal grooves, the cylinder rotating in a direction indicated by the arrow $f_1$ in FIG. 1. The upper parts of the grooves accommodate the needles and the lower parts of these grooves accommodate selectors 3 in the form of rocking jacks. In particular, in FIG. 2, a lowered jack and a raised jack 3 are shown. The jacks 3 have an upper end 3A directly or indirectly acting on the needles to raise them, a guide butt 3B, an area 3C without any butts, a series of removable butts 3E, and a lower end butt 3F. The butts 3E co-operate with levers 5 of a row of selectively insertable thrust levers whereby certain of the jacks 3 are thrust into their associated cylinder grooves as will be described hereinafter.

Below and above the row of levers 5 there is provided a lower guide track 7 and an upper guide track 9. The upper track 9 has a concave portion 9A in correspondence of a raising zone for the jacks 3 and the needles 1 and this concave portion follows the trajectory of the butts 3B of the raised jacks. The portion of the trajectory followed by the butts of the raised needles is denoted by $T_1$ and the raised needles pick up the yarn at a feed indicated at A. It will be noted that in FIG. 1, after the portion $T_1$ in the direction of movement of the needle cylinder there is a lowering or stitch-forming cam 12 with a corresponding counter-cam 12A. 112 and 112A indicate cams, corresponding to the cams 12 and 12A and associated with a working zone and a yarn feed preceding the feed marked at A.

In the raising zone, the track 7 is provided with a cam 16 which acts on the butts 3F of those jacks which are not urged by one of the levers 5 into its associated groove in the needle cylinder. More particularly each of the jacks 3 can be rocked on its own plane, that is a plane diametral to the cylinder 1, about a point 30. The lower end of each of the jacks 3 is normally urged radially outwardly from its associated cylinder groove by the action of a cam 6 which acts on the inner edge of the jack. The action of the cam 6 is interrupted immediately before the selection levers 5, in such a manner as to allow those levers 5 which are selected to co-operate with selected butts 3E to urge inwardly into the cylinder grooves the lower end portion of those jacks which are not to be raised in the raising zone. Those jacks which are to be raised are not engaged by the levers 5, whereby the lower end portions of these jacks continue to project from the cylinder grooves so that their butts 3F can engage and be raised by the cam 16 so as to raise the associated needles onto the portion $T_1$ of the trajectory T.

The butts 3F of the raised jacks 3 remain engaged with the cam 16 and the butts 3B of these jacks are engaged with the portion 9A of the track 9. In contrast, the jacks 3 which are not raised by the cam 16 remain free within the grooves and are able to move vertically in the space defined by the concave portion 9A. This possibility of movement may lead to drawbacks, especially at high cylinder speeds, because even small incidental forces may be sufficient to cause an unintentional raising of these jacks, and thus of the corresponding needles.

Figure 3:
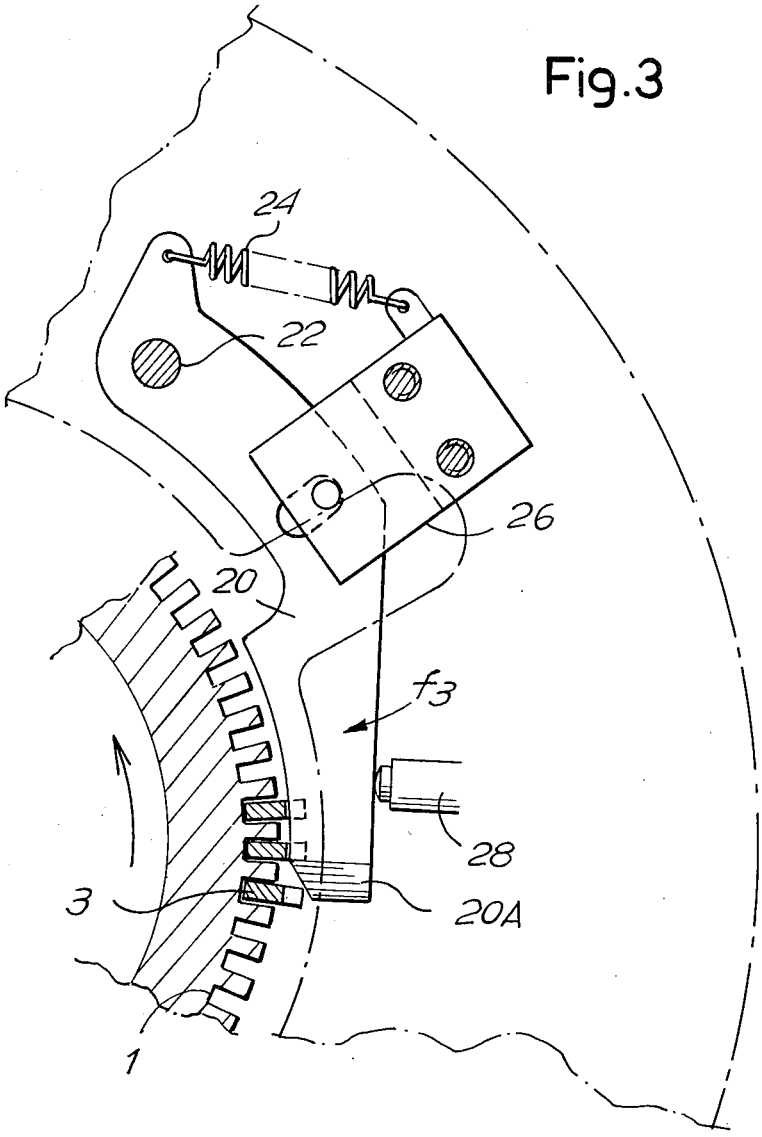
FIG. 3 is a plan view taken on line III—III of FIG. 1.

In the arrangement shown in the drawings, in order to avoid unintentional raising of the jacks which are not raised by the cam 16, there is provided in correspondence of the concave portion 9A, a cam 20 which extends parallel to the track 7 and acts on the butts 3B of those jacks which are not raised by the cam 16 so as to prevent positively these jacks from being raised. The cam 20 does not obstruct the raising of the other jacks which are intended to be raised, since the butts 3B of these jacks pass over the forward end portion 20A of the cam 20, which is appropriately chamfered on its upper surface. This end portion of the cam 20 also has a radially-inclined entry profile 20B which is engaged by the butts 3B of any jacks which may have been raised unintentionally by a short distance before reaching the cam 20. The cam 20 is pivotally mounted on a pin 22 (FIG. 3) and is pivotally biased by means of a spring 24 in the direction of the arrow $f_3$, that is radially towards the cylinder 1, against a stop which defines the normal position of the cam 20 with respect to its support 26, the spring 24 being interposed between the cam 20 and the support 26. If any of the jacks has been raised unintentionally before reaching the cam 20, the butt 3B of this jack will engage the profile 20B and pivot the cam 20 outwardly against the bias of the spring 24 thus preventing this butt from being jammed against the cam 20 which could lead to a breakdown. This movement of the cam 20 may be used to operate a microswitch 28 in order to stop the machine.

Once the butts 3B of the jacks 3 which have not been raised, have engaged the lower profile of the cam 20, these jacks cannot be unintentionally raised.

Although in the arrangement particularly described, each jack has a zone 3C without butts which separates the butt 3B from the butts 3E, if the butt 3B is substantially longer than the butts 3E, it may be possible to dispense with the butt-free zone 3C, so that the butt 3B is immediately adjacent the butts 3E; in this case, the cam 20 will act on the projecting distal end of the butt 3B.

What is claimed is:

1. In a circular knitting machine, rocking selector jacks having butts including: selection butts, needles associated with the jacks, means co-operating with the selection butts to provide a selection of said selector jacks, a first, raising, cam for raising the selected jacks whereby the associated needles are raised in a zone to take a yarn, and a second cam located in correspondence of said raising zone being defined by a forward end portion including an entry profile, said entry profile being inclined to the radial direction of the cylinder, and being further defined by a lower profile extending parallel to the trajectory of the jacks which have not been raised by the raising cam, said lower profile of the second cam co-operating with a butt of the latter jacks to prevent unintentional raising thereof, said butt being longer than butts adjacent thereto; and resilient bias means biasing the second cam whereby the second cam can be displayed against said bias, by a said butt of a jack which has been raised, unintentionally, prior to reaching the second cam.

2. In a circular knitting machine, a needle cylinder, rocking selector jacks carried by the needle cylinder, said jacks having butts including selection butts, needles carried by the needle cylinder and associated with the selector butts, thrust means arranged to act on the selection butts to provide a selection of said selector jacks, first, raising, cam for raising selected ones of the jacks in accordance with the selection determined by the thrust means whereby the associated needles are raised in a zone to take a yarn, means defining a guide track having a lower profile which co-operates with a butt of the jacks, said lower profile of the guide track having a concave portion in the raising zone and which follows the trajectory of the butts of the raised jacks, and a second cam located in correspondence of said raising zone, said second cam having a lower profile extending parallel to the trajectory of those jacks which have not been raised by the raising cam, a forward end portion of said second cam including an entry profile, said entry profile being inclined to the radial direction of the cylinder, said lower profile of the second cam co-operating with a butt of the latter jacks to prevent unintentional raising thereof, and said butt is longer than the butts adjacent thereto, and resilient bias means biasing the second cam towards the needle cylinder whereby the second cam can be displaced away from the cylinder against said bias, by a said butt of a jack which has been raised, unintentionally, prior to reaching the second cam.

3. A knitting machine according to claim 1, further comprising stop switch means, said switch means being actuable in response to displacement of the second cam away from the cylinder, whereby to stop the machine.

* * * * *